US005389056A

United States Patent [19]

Ricker

[11] Patent Number: 5,389,056

[45] Date of Patent: Feb. 14, 1995

[54] LIGHTED JUMP ROPE ASSEMBLIES

[76] Inventor: Edward W. Ricker, 8806 Patricia Ct., College Park, Md. 20740

[21] Appl. No.: 151,009

[22] Filed: Nov. 12, 1993

[51] Int. Cl.[6] ..... A63B 5/00

[52] U.S. Cl. ..... 482/82; 446/485; 439/13

[58] Field of Search ..... 482/82; 446/485; 439/13, 27

[56] References Cited

U.S. PATENT DOCUMENTS

| | | | |
|---|---|---|---|
| 3,415,515 | 12/1968 | Otto | 482/82 |
| 4,281,832 | 8/1981 | Quinby, Jr. | 482/82 |
| 4,529,193 | 7/1985 | Kuhnsman | 482/82 X |
| 4,776,585 | 10/1988 | Maleyko et al. | 482/82 |

FOREIGN PATENT DOCUMENTS

| | | | |
|---|---|---|---|
| 2276069 | 1/1976 | France | 482/82 |
| 0000559 | of 1902 | United Kingdom | 482/82 |

*Primary Examiner*—Richard J. Apley
*Assistant Examiner*—Glenn E. Richman

[57] ABSTRACT

A new and improved jump rope assembly with illuminated components comprising, a pair of handles, each handle having an inboard end and an outboard end, one of the handles being hollow and having therein electrical components including a battery, electrical contacts and an on/off switch. A flexible rope is formed in a hollow tubular configuration from a translucent material and having therein a plurality of light bulbs with spherical translucent covers thereover and with electrical wires coupling the light bulbs interiorly along the length of the rope. A pair of connectors mechanically couple the ends of the rope with the adjacent end of a handle, one of the connectors being electrically conductive and coupling the wires in the rope with the batteries and the switch for selective illumination of the bulbs when the switch is in the on position.

1 Claim, 3 Drawing Sheets

LIGHTED JUMP ROPE ASSEMBLIES

BACKGROUND OF THE INVENTION

1. Field of the Invention

The present invention relates to lighted jump rope assemblies and more particularly pertains to illuminating a jump rope with bulbs, powered and controlled through mechanisms in one handle.

2. Description of the Prior Art

The use of jump ropes is known in the prior art. More specifically, jump ropes heretofore devised and utilized for the purpose of playing games and exercising are known to consist basically of familiar, expected, and obvious structural configurations, notwithstanding the myriad of designs encompassed by the crowded prior art which has been developed for the fulfillment of countless objectives and requirements.

By way of example, the prior art discloses a large number of jump ropes. By way of example, U.S. Pat. No. 4,529,193 to Kuhnsman discloses an illuminatable jump rope device.

U.S. Pat. No. 4,776,585 to Maleyko discloses an electrically lighted jump rope.

U.S. Pat. No. 5,071,118 to Barnett discloses an illuminated jump rope apparatus.

U.S. Pat. No. 5,087,034 to Solis discloses an illuminated jump rope.

U.S. Pat. Nos. Des. 256,385 to Fields and Des. 263,326 to Cooper disclose designs of jump ropes.

In this respect, lighted jump rope assemblies according to the present invention substantially depart from the conventional concepts and designs of the prior art, and in doing so provides an apparatus primarily developed for the purpose of illuminating a jump rope with bulbs, powered and controlled through mechanisms in one handle.

Therefore, it can be appreciated that there exists a continuing need for new and improved lighted jump rope assemblies which can be used for illuminating a jump rope with bulbs, powered and controlled through mechanisms in one handle. In this regard, the present invention substantially fulfills this need.

SUMMARY OF THE INVENTION

In view of the foregoing disadvantages inherent in the known types of jump ropes now present in the prior art, the present invention provides improved lighted jump rope assemblies. As such, the general purpose of the present invention, which will be described subsequently in greater detail, is to provide a new and improved lighted jump rope assemblies and methods which have all the advantages of the prior art and none of the disadvantages.

To attain this, the present invention essentially comprises a new and improved jump rope assembly with illuminated components comprising, in combination, a pair of handles, each handle having an inboard end and an outboard end, one of the handles being hollow and having therein electrical components including a battery, electrical contacts and an on/off switch. A flexible rope is formed in a hollow tubular configuration from a translucent material and having therein a plurality of light bulbs with spherical translucent covers thereover and with electrical wires coupling the light bulbs interiorly along the length of the tubular member. A loop handle is formed and attached to the outboard end of each handle for the receipt of the user's hand. A pair of dumb bell shaped rotary connectors mechanically couple the ends of the rope with the adjacent end of a handle, one of the connectors being electrically conductive and coupling the wires in the rope with the batteries and the switch for selective illumination of the bulbs when the switch is in the on position. The electrically conductive connector have associated therewith an electrically conductive first washer secured to end of the hollow handle facing the rope in contact with a wire of the handle and an electrically conductive second washer secured to the end of the rope in facing contact with the first washer and in contact with a wire in the rope The switch is formed of a slidable member movable between an inoperative orientation wherein the contacts of the electrical components within the handle are out of contact with each other and an operative orientation wherein the electrical contacts within the handle are in electrical contact one with another to effect the flow of current between the batteries and the bulbs.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved lighted jump rope assemblies which have all the advantages of the prior art jump ropes and none of the disadvantages.

It is another object of the present invention to provide new and improved lighted jump rope assemblies which may be easily and efficiently manufactured and marketed.

It is a further object of the present invention to provide new and improved lighted jump rope assemblies which are of a durable and reliable construction.

An even further object of the present invention is to provide new and improved lighted jump rope assemblies which are susceptible of a low cost of manufacture with regard to both materials and labor, and which accordingly are then susceptible of low prices of sale to the consuming public, thereby making such lighted jump rope assemblies economically available to the buying public.

Still yet another object of the present invention is to provide new and improved lighted jump rope assemblies which provide in the apparatuses and methods of the prior art some of the advantages thereof, while simultaneously overcoming some of the disadvantages normally associated therewith.

Lastly, it is an object of the present invention to provide a new and improved jump rope assembly with illuminated components comprising, a pair of handles, each handle having an inboard end and an outboard end, one of the handles being hollow and having therein electrical components including a battery, electrical contacts and an on/off switch. A flexible rope is formed in a hollow tubular configuration from a translucent material and having therein a plurality of light bulbs with spherical translucent covers thereover and with electrical wires coupling the light bulbs interiorly along the length of the rope. A pair of connectors mechanically coupling the ends of the rope with the adjacent end of a handle, one of the connectors being electrically conductive and coupling the wires in the rope with the batteries and the switch for selective illumination of the bulbs when the switch is in the on position.

As to the manner of usage and operation of the present invention, the same should be apparent from the above description. Accordingly, no further discussion relating to the manner of usage and operation will be provided.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
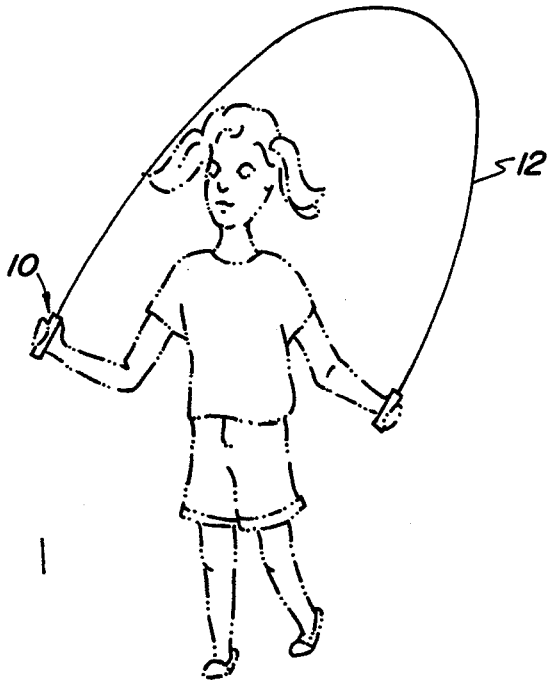
FIG. 1 is a perspective view of the preferred embodiment of the lighted jump rope assembly constructed in accordance with the principles of the present invention.
Figure 2:
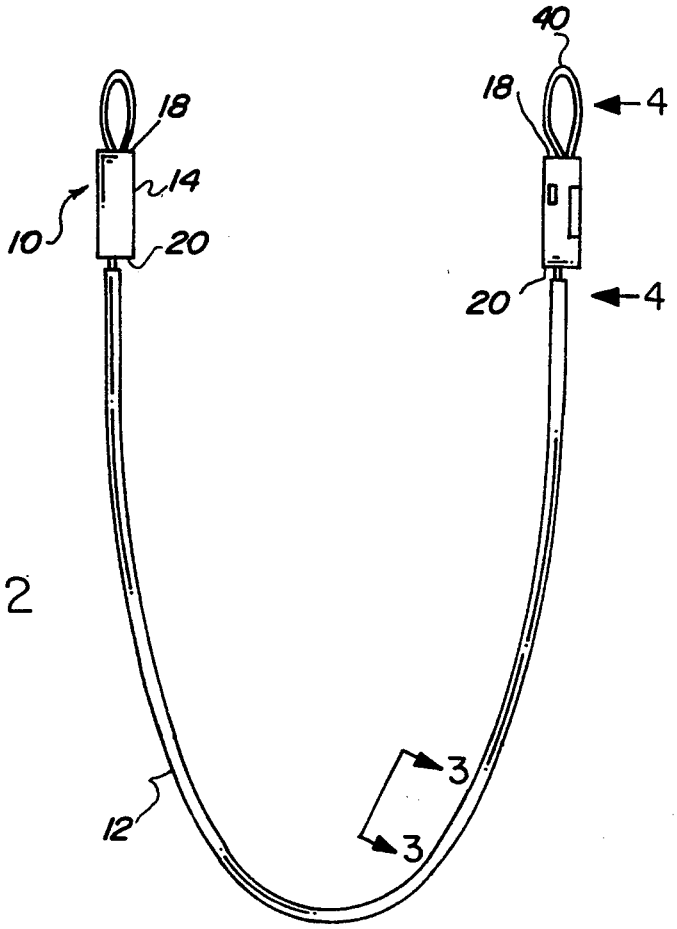
FIG. 2 is a plan view of the lighted jump rope assembly as shown in FIG. 1.
Figure 3:
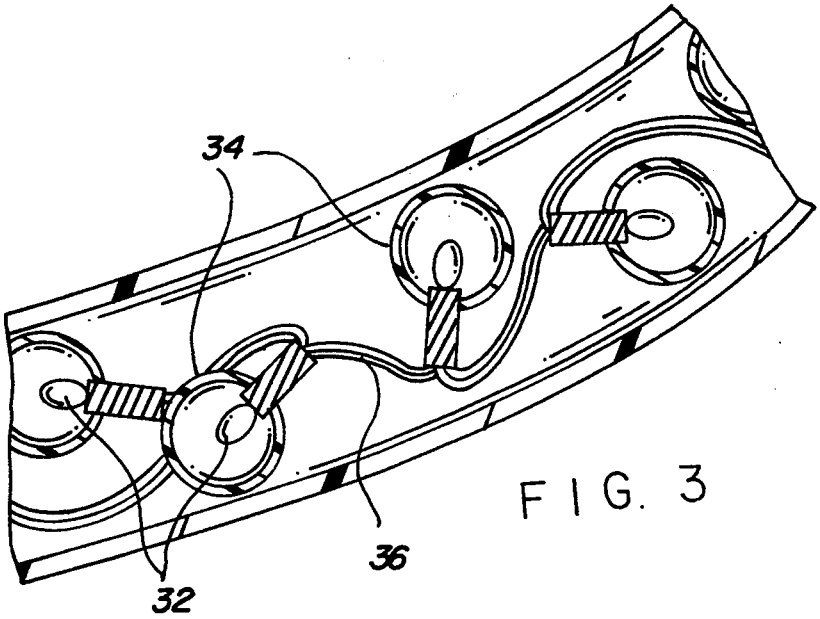
FIG. 3 is an enlarged sectional view through the center of the elongated rope taken along line 3—3 of FIG. 2.
Figure 4:
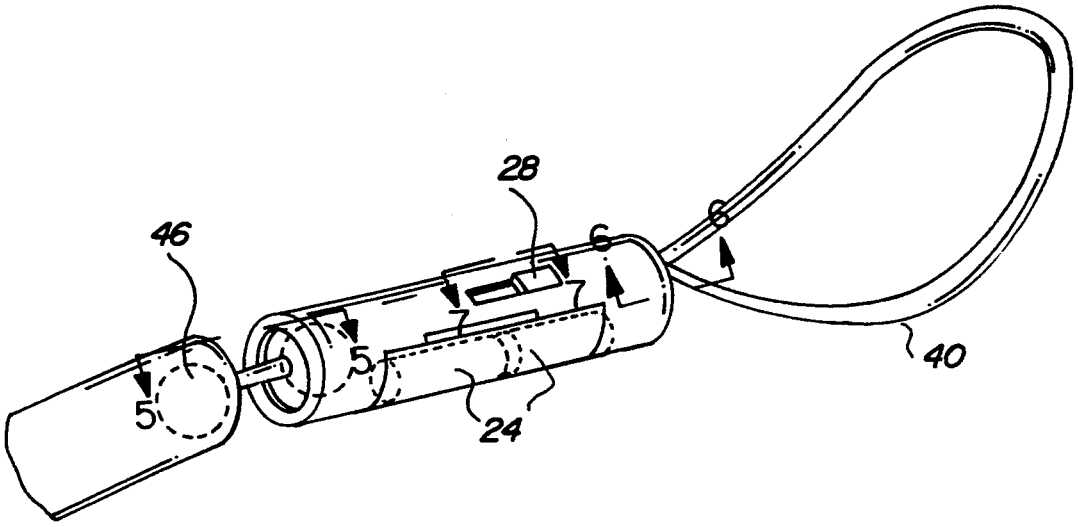
FIG. 4 is an enlarged perspective illustration of the handle.
Figure 5:
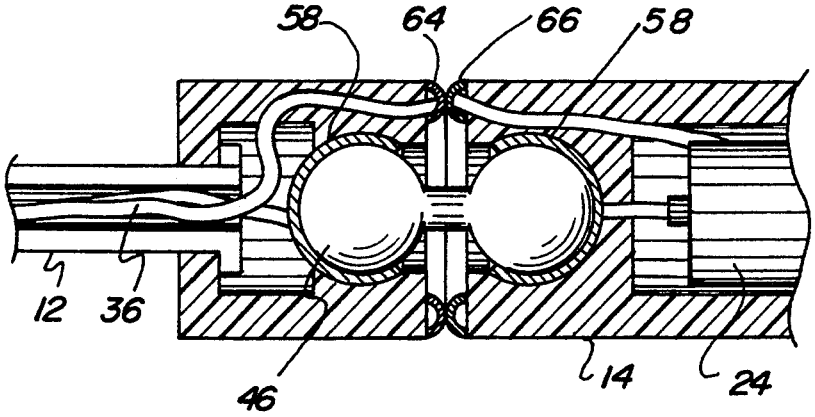
FIG. 5 is an enlarged sectional view of the device of taken along line 5—5 of FIG. 4.
Figure 6:
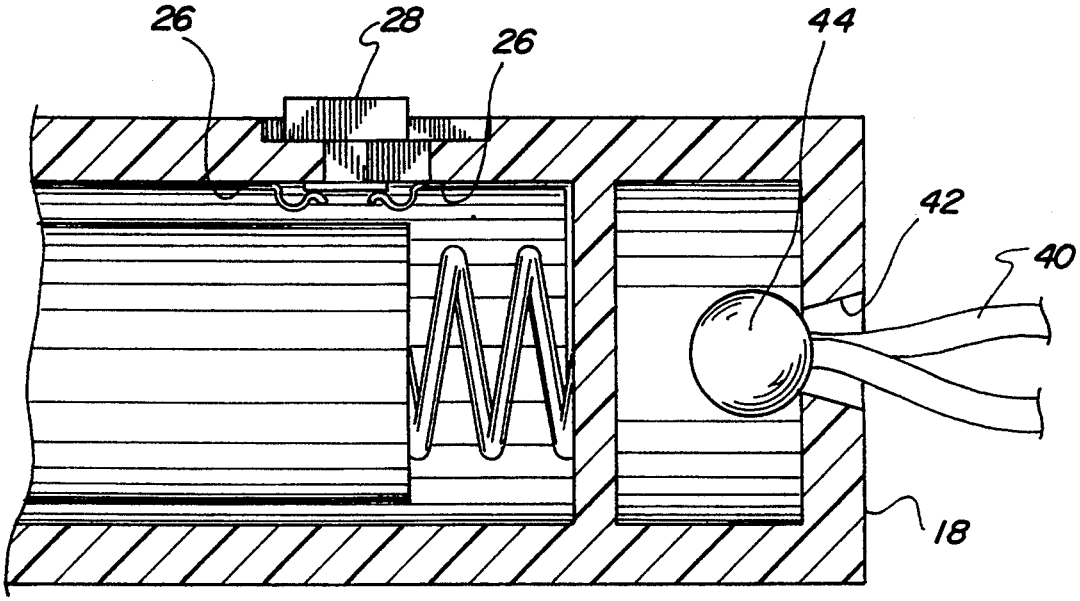
FIG. 6 is an enlarged sectional view of the device taken along line 6—6 of FIG. 4.

With reference now to the drawings, and in particular to FIG. 1 thereof, the preferred embodiment of the new and improved illuminated jump rope assemblies embodying the principles and concepts of the present invention and generally designated by the reference numeral 10 will be described.

More specifically, it will be noted in the various Figures that there is shown a new and improved illuminated jump rope assembly 10. The major components of the jump rope assembly are the rope 12, handle 14 and associated components.

More specifically, there is provided a pair of handles. Each handle has an inboard end 18 and an outboard end 20. One of the handles is hollow forming a cavity 22 with electrical components therein, such electrical components include a battery 24, electrical contacts 26 and an on/off switch 28.

The second major component of the assembly is a flexible rope 12. The rope is formed in a hollow tubular configuration from a translucent material. Located within the cylindrical walls of the rope are plurality of light bulbs 32. Each bulb has a spherical translucent cover 34 thereover. Each cover may be of a common color or the covers may be of contrasting colors. Electrical wires 36 couple the light bulbs interiorly along the length of the tubular member. The free ends of the wires terminate at the end of the rope adjacent to the hollow handle containing the electrical components.

A loop handle 40 is formed and attached to the outboard end of each handle. Such loop handles 40 are for the receipt of the user's hand. Coupling to the handles 14 of the assembly 10 is by extending the free ends of the loop handle into an aperture 42 in the handle assembly 10. Retention is through a ball 44 at the end of the handles.

A pair of dumb bell shaped rotary connectors 46 mechanically couple the ends of the rope with the adjacent end of a handle. One of the connectors 46 is electrically conductive for electrically coupling the bulbs and a wire in the rope with a wire in the handle. The wire in the handle couples with the batteries and the switch for selective illumination of the bulbs when the switch is in the on position. Each connector 46 has an enlarged ball 52 and within adjacent end walls 60 of the handle and rope. A thin connector 56 extends through end apertures to allow a mechanical coupling which allows for rotation.

Generally spherically shaped supports 58 are attached to the interior faces of the end walls 60. Such supports hold the balls 52 and 54 in position. The supports 60 and connectors 46 are of an electrically conductive material, or at least have an electrically conductive surface, to allow for the flow of current therethrough. The outboard exterior ends of the supports 58 are attached to the electrical wires of the rope 12 and handle 14 for completing the circuit.

The other wire in the rope is electrically coupled to the other wire in the handle through a pair of washers 64 and 66, rotatable with respect to each other. The washers 64 and 66 are concentrically secured to the adjacent faces of the end walls 60. They are bowed outwardly at their central circumferences to ensure sliding contact therebetween. Each remote face of the washers receives a wire, one in the handle and one in the rope. By fabricating the washers of an electrically conductive material, a rotatable electrical coupling is formed.

The final component of the assembly is the switch 28. The switch 28 is formed of a slidable member movable between an inoperative orientation wherein the contacts 26 of the electrical components within the handle are out of contact with each other and an operative orientation wherein the electrical contacts within the handle are in electrical contact one with another. When so coupled, there is established a flow of current between the batteries and the bulbs through the switch, wires, washers and connector so as to attain the intended illumination of the rope.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved jump rope assembly with illuminated components comprising, in combination:

a pair of handles, each handle having an inboard end and an outboard end, one of the handles being hollow and having therein electrical components including a battery, electrical contacts and an on/-off switch;

a flexible rope formed in a hollow tubular configuration from a translucent material and having therein a plurality of light bulbs with spherical translucent covers thereover and with electrical wires coupling the light bulbs interiorly along the length of the rope;

a loop handle formed and attached to the outboard end of each handle for the receipt of the user's hand;

a pair of dumb bell shaped rotary connectors mechanically coupling the ends of the rope with the adjacent end of a handle, one of the connectors being electrically conductive with spherical end members and spherically shaped supports for rotatably receiving the end members and coupling the wires in the rope with the battery and the switch for selective illumination of the bulbs when the switch is in the on position;

the electrically conductive connector having associated therewith an electrically conductive first washer with a semicircular cross section secured to the end of the hollow handle facing the rope in contact with a wire of the handle and an electrically conductive second washer with a semicircular cross section secured to the end of the rope in facing contact with the first washer and in contact with a wire in the rope; and the switch being formed of a slidable member movable between an inoperative orientation wherein the contacts of the electrical components within the handle are out of contact with each other and an operative orientation wherein the electrical contacts within the handle are in electrical contact one with another to effect the flow of current between the battery and the bulbs.

* * * * *